US005573376A

United States Patent [19]

Hayden et al.

[11] Patent Number: 5,573,376

[45] Date of Patent: Nov. 12, 1996

[54] BLADED DEVICE AND METHOD OF MANUFACTURING SAME

[75] Inventors: Christopher T. Hayden; Jon A. Hixson, both of San Diego, Calif.

[73] Assignee: Sundstrand Corporation, Rockford, Ill.

[21] Appl. No.: 536,813

[22] Filed: Sep. 29, 1995

[51] Int. Cl.[6] ..... F04D 29/34

[52] U.S. Cl. ..... 416/193 A; 416/203; 416/220 A; 416/221; 415/912; 29/888.025; 29/889.21; 29/889.3; 29/889.1

[58] Field of Search ..... 416/193 A, 203, 416/204 R, 213 A, 219 A, 220 A, 220 R, 221; 415/912; 29/888.02, 888.021, 888.025, 889, 889.1, 889.21, 889.3

[56] References Cited

U.S. PATENT DOCUMENTS

| | | | |
|---|---|---|---|
| 1,090,271 | 3/1914 | Bryan | 416/221 |
| 2,302,437 | 11/1942 | Frisbie . | |
| 2,573,875 | 11/1951 | Riddiford | 415/912 |
| 3,071,195 | 1/1963 | Osmaston . | |
| 3,179,329 | 4/1965 | Dybvig . | |
| 3,407,882 | 10/1968 | Wooden et al. . | |
| 3,952,712 | 4/1976 | Hermanson . | |
| 4,047,843 | 9/1977 | Zeidler et al. | 416/221 |
| 4,820,127 | 4/1989 | Cohen et al. | 416/221 |
| 5,354,177 | 10/1994 | Chang . | |

FOREIGN PATENT DOCUMENTS

| | | | |
|---|---|---|---|
| 3839467 | 5/1990 | Germany | 416/221 |

*Primary Examiner*—James Larson
*Attorney, Agent, or Firm*—Lawrence E. Crowe

[57] ABSTRACT

An apparatus is provided that includes a bladed device having a hub which is rotatable about an axis and one or more blades attached to the hub by self-energizing, self-locking, insertion and retention features which are formed integrally with the blade and hub. The insertion and retention features include a locking tang formed integrally with the root of the blade, and detent features which are part of the locking tang and hub. As the blade is inserted axially into the hub, the locking tang deflects radially inward and then snaps radially outward by spring action of the tang to engage the detent feature of the hub, and thereby lock the blade against further axially or radially movement with respect to the hub. The locking tang is oriented and configured in such a manner that the locking tang is self-energizing, thereby causing the tang to grip the hub more tightly as rotational speed of the bladed device increases. The blades are configured to be readily removed for replacement with another blade of similar or different configuration, thereby facilitating manufacture, repair, and alternating performance of the bladed device. By inserting a hub filler into the hub in place of one or more of the blades, the performance of the bladed device may be readily modified by reducing the number of blades attached to the hub.

30 Claims, 6 Drawing Sheets

BLADED DEVICE AND METHOD OF MANUFACTURING SAME

TECHNICAL FIELD

Our invention is related to apparatus including bladed devices having one or more blades extending from a rotatable hub. Our invention is particularly useful for manufacturing or repair of bladed devices used to react fluids in turbomachines and for conveniently altering the performance of such turbomachines.

BACKGROUND

It is sometimes desirable to fabricate a bladed device by joining one or more separable blades to a hub. This is often the case in turbomachines such as propellers, rotary fans, compressors, turbines, or pumps which utilize rotating bladed devices to respectively impart or extract energy to or from a flow of fluid passing through the bladed device.

In some instances the bladed devices of turbomachines incorporate complex shapes which preclude their economical production as a single piece. Specifically, tooling costs and procedures or scrap rates may be so high that manufacture of the bladed device as a single unitary part is not practical.

In other instances, it is desirable to have a single turbomachine be capable of operating alternatively in a variety of installations requiring different performance characteristics from the turbomachine. By making the blades separable, a family of turbomachines may conveniently be provided to meet the requirements of various installations by simply changing the number or the configuration of the blades to provide a flow rate or pressure differential through the bladed device that is closely matched to the particular installation. With such an approach, the elements of the turbomachine other than the blades, such as drive motors, gear trains, housings, and the hub of the bladed device, may be common to all members of the family of turbomachines. Such commonality of elements offers significant manufacturing economy, thereby leading to reduced inventory levels and cost.

Another advantage of having separable blades is the ability to individually remove and replace damaged blades, or a damaged hub, thus precluding the need for the additional cost of replacing the entire bladed device. It is also desirable in some instances to utilize separable blades having similar fluid reacting configurations, but differing dynamic moments of inertia for balancing the bladed device without resorting to traditional methods of removing or adding material to the hub solely for the purpose of balancing.

Some prior attempts to provide a bladed device as described above have required the use of adhesives, fasteners, welding, or other retention means in addition to the blades and hub themselves for retaining and positioning the blades in the hub. Such approaches are illustrated in U.S. Pat. Nos. 5,354,177 to Chang, and U.S. Pat. No. 3,071,195 to Osmaston. The use of such additional retention means adds undesirable complexity and cost. It is therefore desirable to incorporate any installation and retention means required for joining the blades to the hub as integral features of the blades and the hub.

Other prior attempts, such as that illustrated by U.S. Pat. No. 3,952,712 to Hermansen have attempted to join a blade or blades to a hub or other rotating assembly using snap-on interlocking engagement tangs, or tongues. Unfortunately these tangs are sometimes configured such that centrifugally generated forces on the tangs while the bladed device is rotating tend to act in a manner leading to disengagement of the tangs, rather than self-energizing the tangs into tighter engagement.

Accordingly, it is an object of our invention to provide a bladed device having one or more blades attached to a hub that is rotatable about an axis in a self-locking manner providing retention of the blades to the hub against axially and radially directed forces acting on the blades with respect to the hub. Other objects of our invention include providing:

1) a bladed device as above in which the means for installing and retaining the blades in the hub are integrally formed as part of the blades and hub, thereby eliminating the need for any additional retention or installation means;
2) a bladed device in which the shape or number of blades attached to a given hub can be conveniently changed to alter the performance of the bladed device or a turbomachine incorporating the bladed device;
3) a bladed device having elements which are readily and economically manufacturable by a variety of processes including injection molding;
4) a method of conveniently producing or readily repairing bladed devices having complex geometries; and
5) a bladed device as above wherein the blades and hub are configured to include integral snap action, self-energizing, and self-locking features for inserting and retaining the blades in the hub.

SUMMARY

Our invention provides a bladed device meeting the above objects through the use of a hub which is rotatable about an axis and one or more blades attached to the hub by self-energizing, self-locking, insertion and retention features which are formed integrally with the blade and hub. The insertion and retention features include a locking tang formed integrally with the root of the blade, and detent features which are part of the locking tang and hub. As the blade is inserted axially into the hub, the locking tang deflects radially inward and then snaps radially outward by spring action of the tang to engage the detent means of the hub and lock the blade against further axial or radial movement with respect to the hub.

The insertion and retention means of our invention are thus self-locking and do not require the use of additional retention means as did prior bladed devices. By virtue of orienting the snap-acting locking tang radially inward from the detent means of the hub, the locking tang is self-energizing, thereby causing the tang to grip the hub more tightly as rotational speed of the bladed device increases. Our invention also allows the blades to be readily removed for replacement with another blade of similar or different configuration, thereby facilitating manufacture, repair, and altering performance of the bladed device. The bladed device of our invention is also readily manufactured by a variety of methods, and is applicable in a wide variety of devices including turbomachines.

Specifically, our invention provides a bladed device including a hub rotatable about an axis and one or more blades attached to the hub by insertion and retention means which are integrally formed with the hub and blade. The insertion and retention means are configured to allow axially directed insertion of the blade into the hub and self-locking retention therein against both axially and radially directed forces acting on the blades with respect to the hub. In some embodiments of our invention, the insertion and retention means are configured to resist axially directed forces acting in only one direction along the axis. In other embodiments, the insertion and retention means are configured to resist axially directed forces acting in either direction along the axis. The insertion and retention means are configured to be self-energizing such that forces generated in the blades or insertion and retention means by virtue of rotation of the hub about the axis urge the retention means to remain locked into the hub. The insertion and retention means are also configured such that following engagement of the insertion and retention means, the blade may be removed from the hub without permanently deforming either the blade or the hub.

According to some embodiments of our invention, the hub is configured to receive a plurality of blades, or alternatively a hub filler means in place of one or more of the blades. The hub filler means include the same integrally formed insertion and retention means provided for joining the blades to the hub. The hub filler means allow a hub which is configured to receive 33 blades, for instance to be reconfigured to receive only 11 blades, with the remaining 22 sites for blades filled with the hub filler means. In this fashion, the pressure rise and/or flow rate of fluid through the bladed device can be reduced significantly without the need for changing the hub configuration or the speed at which the bladed device rotates about the axis.

According to a preferred embodiment of our invention, the insertion and retention means of the bladed device includes an axially opening and directed blade retention slot in the hub, and a blade root fitting integrally joined to the blade at a radially inner end thereof. The blade root fitting is configured to enter the blade retaining slot of the hub in an axial direction, with the root fitting and slot being configured in a complimentary manner to provide retention of the blade within the slot against radially directed forces acting on the blade. The root fitting includes a radially flexible, snap-action, locking tang extending axially therefrom into the hub. The locking tang and hub include axial positioning and detent means for locking the blade into the hub against the action of axially directed forces operating on the blade with respect to the hub. The detent means are configured in such a manner that as the blade is inserted into the hub, the locking tang is deflected radially inward at an axial position prior to a predetermined axial engagement location of the blade with respect to the hub. When the blade reaches the predetermined axial engagement location, the locking tang snaps radially outward due to spring action of the locking tang and locks the blade into the hub. The detent means are configured to allow removal of the blade without damage or permanent deformation of either the blade or hub even after the detent means have locked the blade into the hub at the engagement location. To remove a blade, the locking tang is simply deflected radially inward to disengage the detent means and the blade is removed in an axial direction while holding the detent means disengaged.

Those skilled in the art will readily recognize that our invention allows a bladed device for a turbomachine to be readily constructed by simply selecting an appropriate blade configuration and snapping the same into the hub. Furthermore, should the blade become damaged, or should it be desirable to alter the performance of the turbomachine by changing the number or configuration of blades, the insertion and retention means of our invention make it very simple to remove and replace the blades originally installed with new blades of similar or different configuration and/or hub filler means for the purpose of either repairing or altering the performance of the bladed device.

Additionally, the ability to readily install or remove blades from the hub, make it relatively easy to balance a bladed device according to our invention. The imbalance of the hub itself, or an assembled bladed device can be measured, and then blades having an appropriate dynamic characteristic installed into the hub to achieve a desired balance condition of the bladed device, without the need for resorting to removal or addition of material to the hub as in some prior bladed devices.

Other objects, aspects, and advantages of our invention will become readily apparent upon consideration of the following drawings and detailed descriptions of preferred embodiments.

DESCRIPTION OF THE INVENTION

Figure 1:
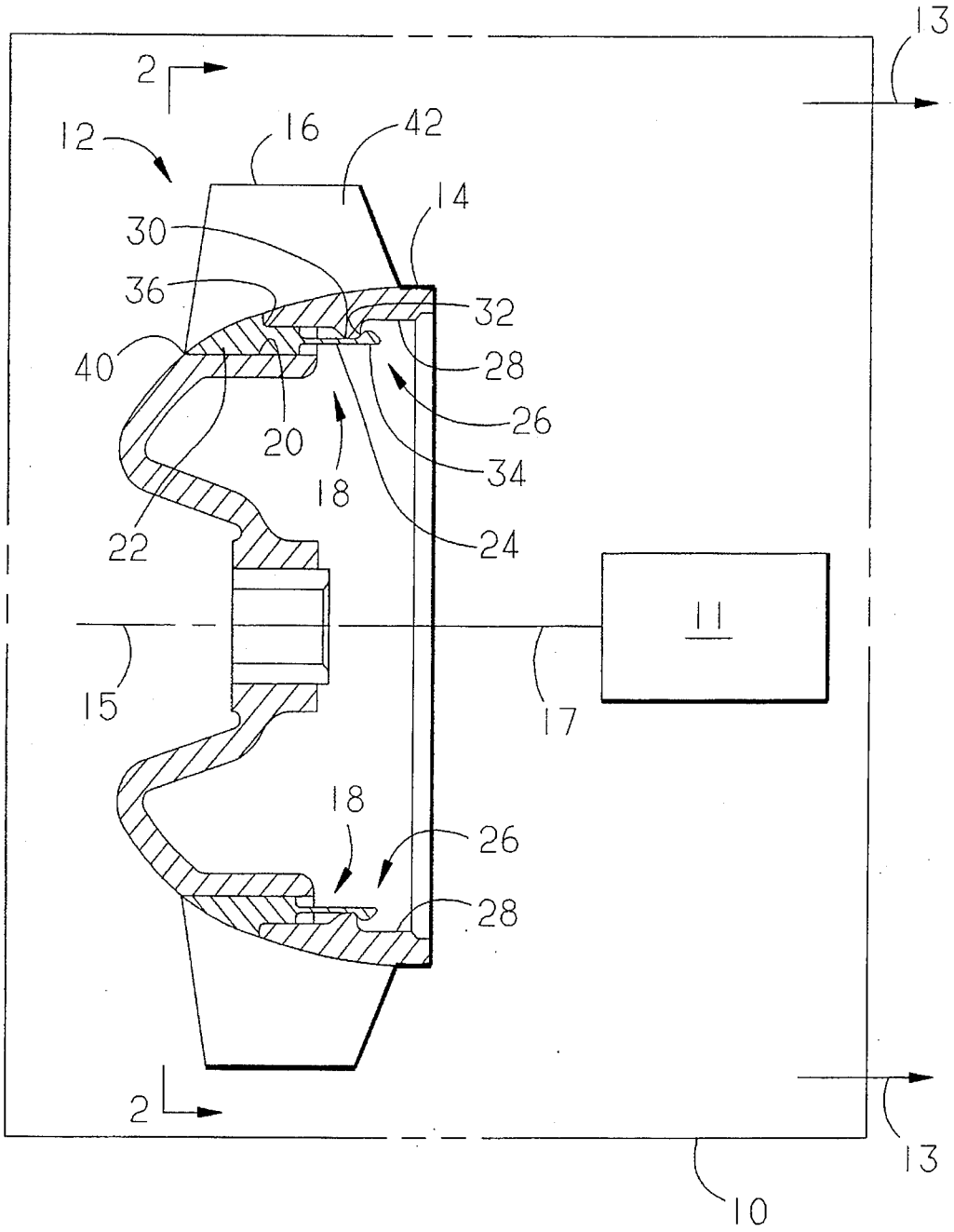
FIG. 1 is a semi-schematic depiction of a turbomachine 10 according to our invention, and includes a cross-sectional view of a bladed device according to our invention.
Figure 2:
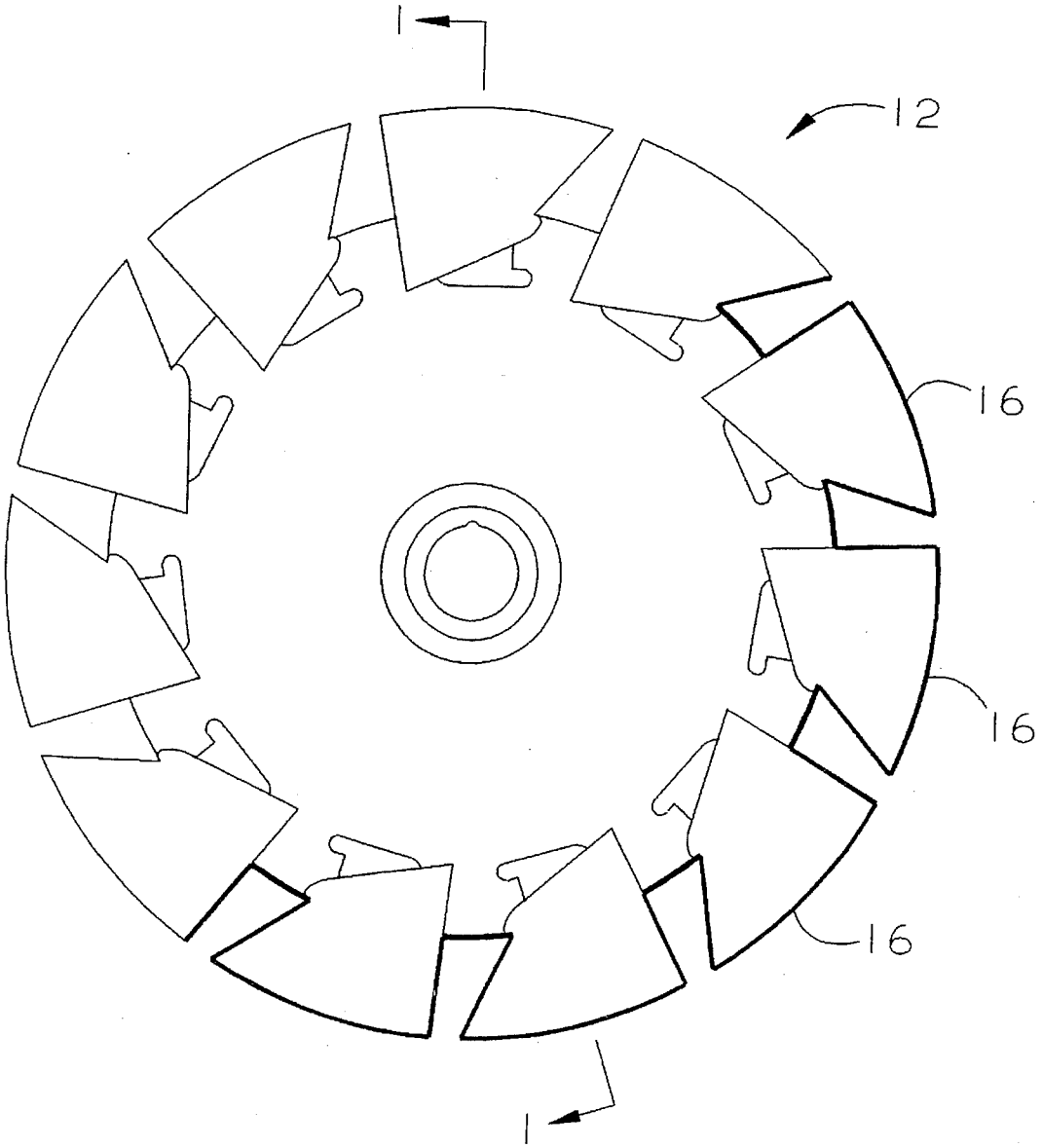
FIG. 2 is an end view of the bladed device of FIG. 1 as viewed along lines 2–2 of FIG. 1.

FIGS. 1 and 2 depict an exemplary embodiment of a turbomachine in the form of a motor driven fan which includes a bladed device according to our invention. As shown in FIG. 1, the fan 10 includes a bladed device in the form of an impeller 12 operably connected by drive means 17 to a motor 11 to be driven thereby about an axis 15. The impeller 12 includes a hub 14 and a plurality of blades 16 attached to the hub 14 and extending radially therefrom to create a flow of air as indicated by arrows 13 when driven by the motor 11.

The impeller 12 includes the hub 14 which is mounted for rotation about the axis 15, and one or more blades 16, in this case 11 blades, attached to the hub 14 by insertion and retention means as generally indicated at reference numeral 18. The insertion and retention means 18 include an axially opening and directed blade retention slot 20 in the hub 14 for receipt of each of the blades 16. The insertion and retention means 18 further include a blade root fitting 22 integrally joined to each of the blades 16 at a radially inner end thereof. The blade root fitting 22 and the slot 20 are configured in a complementary manner to provide retention of the blade 16 within the slot 20 against radially directed forces acting on the blade 16. The blade root fitting 22 includes a radially flexible, snap-action, self-locking tang 24 extending axially therefrom into the hub 14. The locking tang 24 and hub 14 include axial positioning and detent means 26 for locking the blade 16 into the hub 14 against the action of axially directed forces operating on the blade 16 with respect to the hub 14.

As shown in FIG. 1, the hub 14 defines a radially inner wall 28 thereof. The detent means 26 include a blade retaining ridge 30 extending radially inward from the radially inner wall 28 to a point of contact 32 with the locking tang 24. The detent means of the exemplary embodiment also includes a radially outward extending locking pawl portion 34 of the tang 24. The detent means 26 in combination are configured such that as the blade 16 is inserted into the hub 14 in an axial direction to the right, as illustrated in FIG. 1, the locking pawl 34 will contact the left edge of the blade retaining ridge 30. As the blade is moved further to the right, the locking pawl 34 and blade retaining ridge 30 cause the locking tang to deflect radially inward as the locking pawl 34 passes by the blade retaining ridge 30. Once the locking pawl portion 34 passes by the blade retaining ridge 30, the locking tang, which is configured to act as a finger spring, causes the locking tang and pawl 24, 34 to snap radially outward, and engage the blade retaining ridge 30 in a manner locking the blade 16 to the hub 14 against movement caused by axially directed forces acting on the blade 16 with respect to the hub 14 in a leftward direction as illustrated in FIG. 1, to thereby retain the blade 16 axially within the hub 14. As indicated at 36 in FIG. 1, the hub 14 and the blade root fitting 22 are configured to include shoulder means 36 for locking the blade 16 and hub 14 together against axially directed forces acting toward the right as illustrated in FIG. 1 on the blade 16 with respect to the hub 14. The combined action of the shoulder means 36 and the detent means 26 of the exemplary embodiment therefore serve to lock the blade 16 against axially movement with respect a to the hub 14, and further serve to define a predetermined axial engagement location of the blade 16 with respect to the hub 14.

Those skilled in the art will readily recognize that by virtue of the configuration described above, the insertion and retention means 18 of our invention are both self-locking, and self-energizing. Specifically, by configuring the detent means 26 in such a manner that the locking tang 24 and pawl are disposed radially inward from the blade retaining ridge 30 of the hub, centrifugally generated forces acting on the tang and pawl 24, 34 will cause the pawl 34 to be urged outward, and to grip the blade retaining ridge 30 more tightly as the impeller 12 is rotated about the axis 15 by the motor 11.

Figure 3:
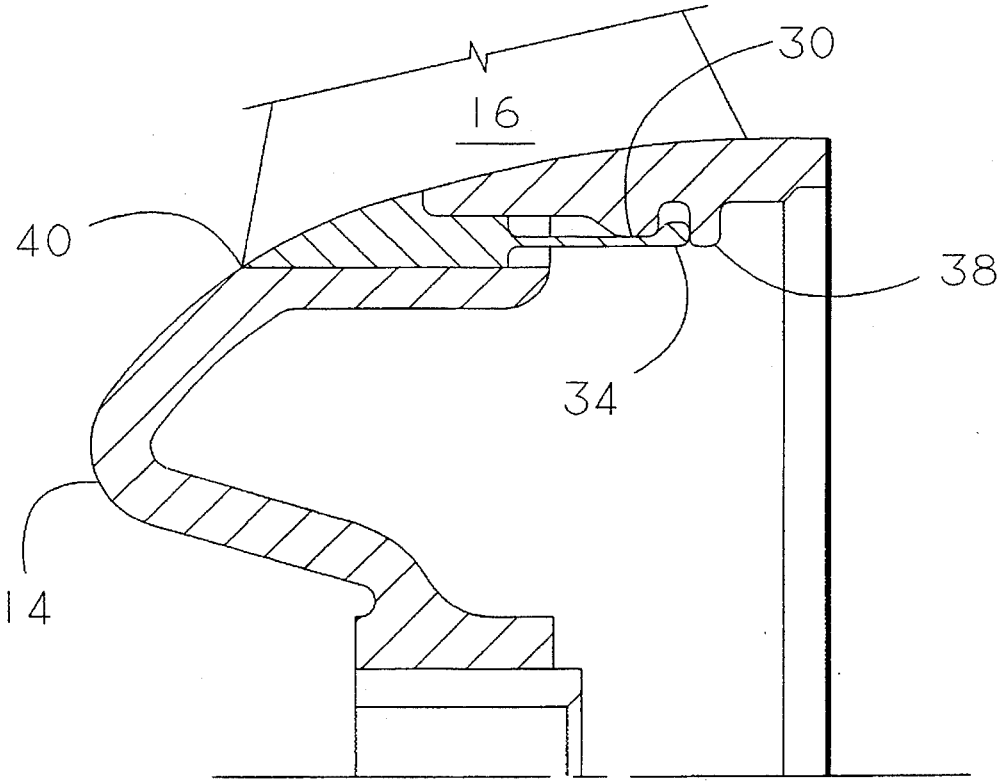
FIG. 3 is a partial cross-sectional view of a bladed device according to our invention depicting an alternate embodiment of a detent means according to our invention.

Those skilled in the art will further recognize that the particular configuration of the blade insertion and retaining means 18 and detent means 26 depicted in FIG. 1 are but one embodiment of many which might be utilized within the scope of our invention. For example, as shown in FIG. 3, the shoulder means 36 of the embodiment of FIG. 1 may be eliminated and a second blade retaining ridge 38 added to the hub at a position opposite a point of insertion 40 of the blade 16 into the hub with respect to the first blade retaining ridge 30, such that when the blade 16 is positioned at the predetermined axial engagement location with respect to the hub 14, the locking pawl 34 will be trapped between the first and second blade retaining ridges 30, 38, thereby presenting further axial motion of the blade 16 in either direction along the axis 15.

Our invention therefore provides a straightforward method of manufacturing the impeller 12 by the simple step of inserting the blade 16 into the slot 20 of the hub 14 in an axial direction to the axial engagement location at which the detent means 26 and shoulder 36 will lock the blade into the hub 14. Where it is desired that the blade 16 not be subsequently removable from the hub 14 the blade 16 may be integrally joined to the hub 14 by a variety of means, using the detent means 26 and shoulder 36 as self-fixturing tooling to properly position the blade 16 within the hub 14 during the joining process. As used herein, the term integrally joining the blade 16 to the hub is contemplated to include any method for welding, brazing, or adhesively bonding the blade 16 and hub 14 together along any of the faying surfaces thereof. For example, where the blades 16 and hub 14 are fabricated from a material such as a 30% glass filled polyetherimide material, sold under the trade name Ultem 2300 by the General Electric Plastics of Pittsfield, Mass., an adhesive such as that sold under the trade name Dexter Hysol EA by the Dexter Hysol Company of Pittsburg, Calif. might be used to bond the blades 16 to the hub 14. The addition of mechanical fastening means such as snap rings or fasteners is to integrally join the blades 16 to the hub 14 is also considered to fall within the scope of our invention.

Figure 4:
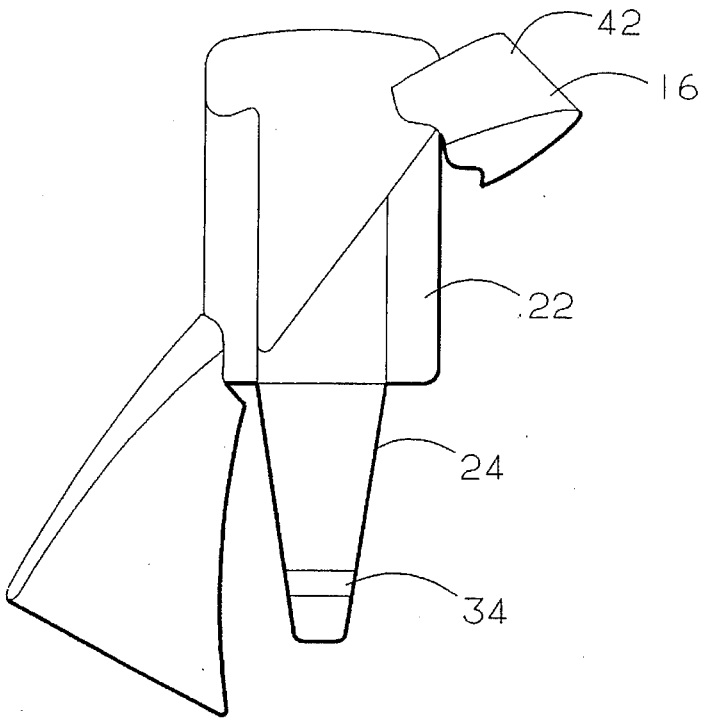
FIGS. 4 and 5 illustrate alternate embodiments of blades in bladed devices according to our invention.
Figure 5:
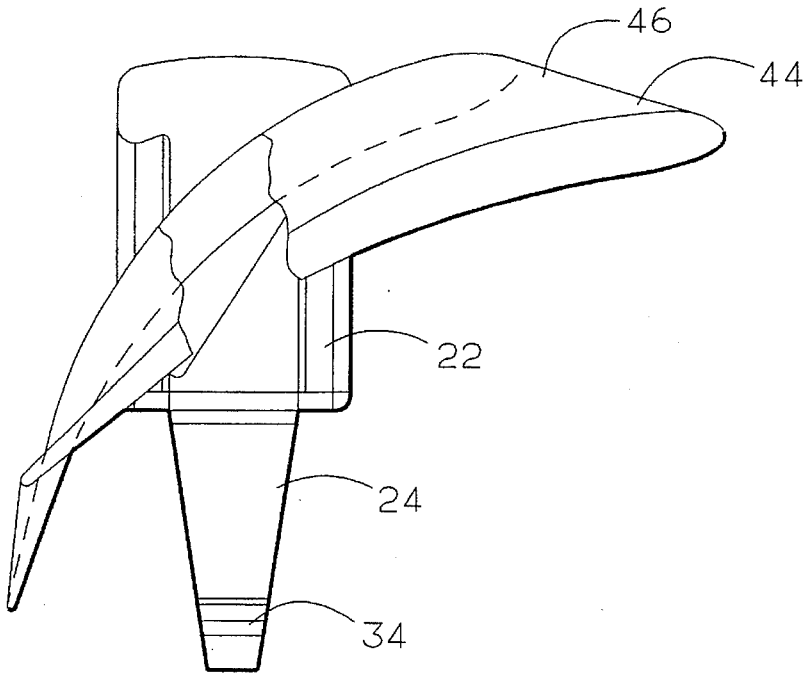

Our invention also provides a method for readily repairing the impeller or changing the performance of the impeller by removing one of the blades 16 from the hub 14 and replacing the blade 16 removed with another blade of similar or different aerodynamic configuration. Specifically, the blade 16 may be readily removed by deflecting the locking tang 24 in a radially inward direction to disengage the locking pawl 34 from the blade retaining ridge 30 of the detent means 26 and, while holding the pawl in a disengaged position, moving the blade 16 axially to the left as illustrated in FIG. 1 to remove the blade 16 from the hub 14. Where the blade 16 has been damaged, the impeller may be easily repaired following removal of the damaged blade 16 by simply replacing the damaged blade 16 with a new blade 16 having a fluid reacting portion 42 configured identically to the damaged blade 16, as shown in FIGS. 1 and 4. Where it is desired to alter the performance of the fan 10 or impeller 12, some or all of the blades 16 may be replaced with a blade 46 having an alternate configuration for its fluid moving portion 44, as illustrated in FIG. 5. As will be obvious by comparing the illustrations in FIG. 4 and FIG. 5, the fluid moving portion 44 of the blade 46 has more curvature then the fluid moving portion 42 of the blade 16 depicted in FIG. 4. The different curvature between the blades 46 and 16 will result in different aerodynamic performance of the impeller 12 resulting in a change in the air flow 13 when driven at a constant speed by the motor 11. Dependent upon the aerodynamic performance of the particular configuration selected for the fluid moving portion of the blades 46, 16 the fan 10 will provide more or less air flow or pressure with blades of differing shapes without the necessity for altering the hub 14 or any other component of the fan 10. Our invention thus allows the performance of the fan 10 to be readily adapted to meet the needs of a particular installation of the fan 10.

Figure 6:
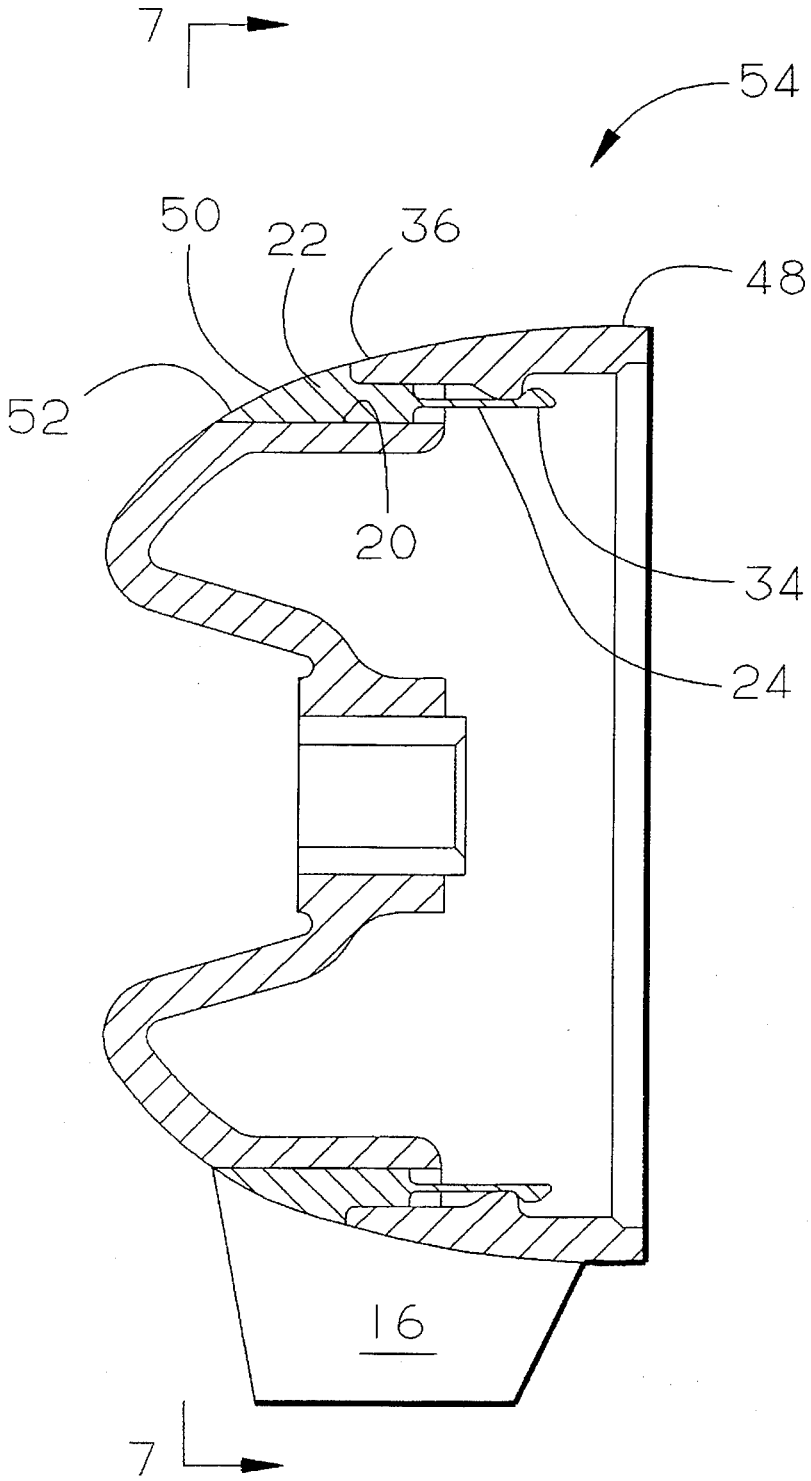
FIGS. 6 and 7 are a cross-sectional view and an end view respectively of an alternate embodiment of our invention depicting hub filler means inserting into the hub of a bladed device according to our invention.
Figure 7:
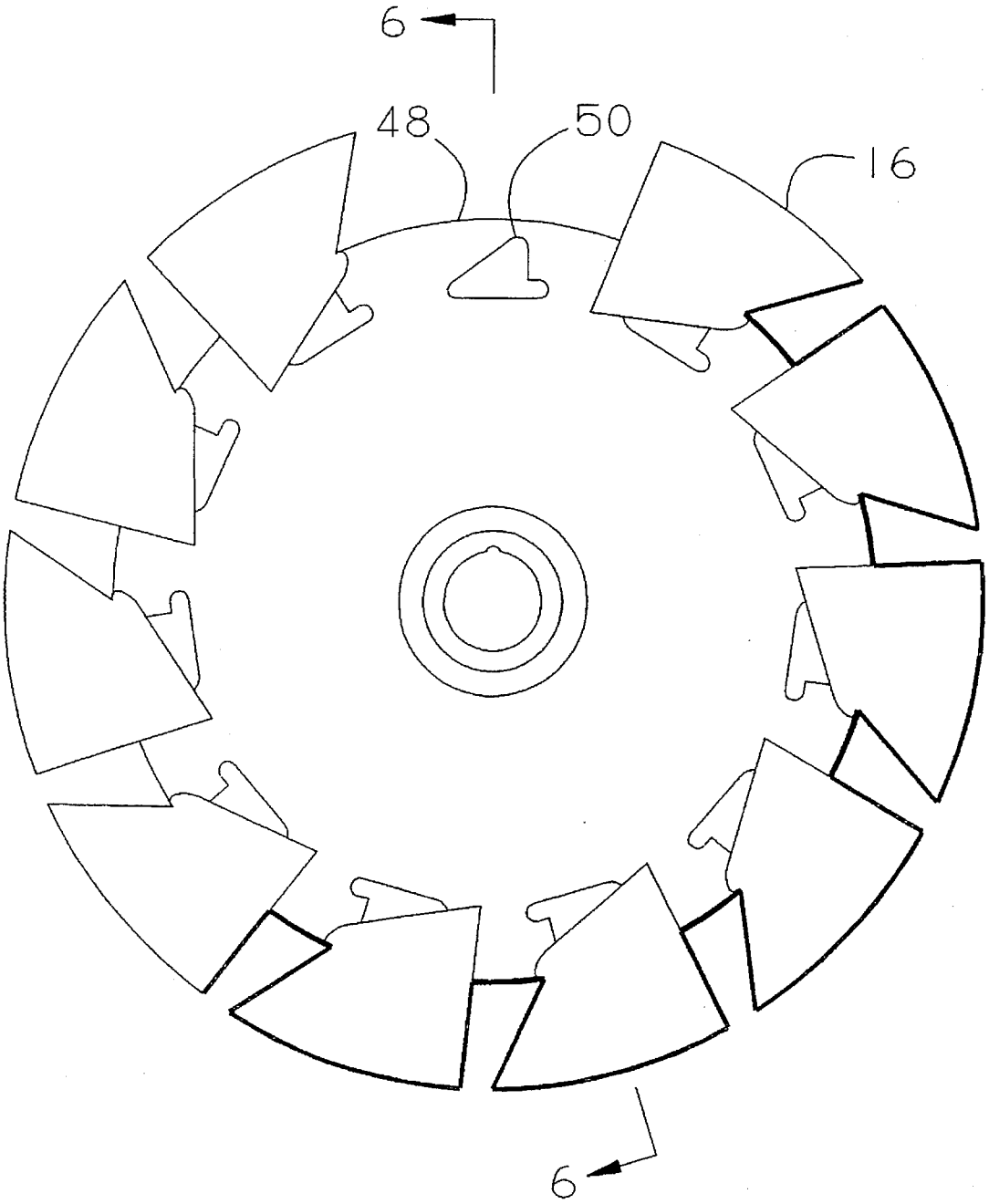

As shown in FIGS. 6 and 7, our invention also makes it easy to alter performance of an impeller 54 by replacing some of the blades 16 with a hub filler means 50 to thereby reduce the number of blades 16 attached to the impeller 54. The hub filler 50 is identical in all respects to the blade 16 except that the fluid moving portion 42 of the blade 16 is removed. The hub filler 50 is installed into the hub 48 in a manner identical to that used to install the blade 16. Stated another way, the hub filler 50 includes a blade root fitting 22, locking tang 24, and locking pawl 34, and a shoulder 36, as depicted in FIGS. 6 and 7, which are identical to the same features of the blade 16. A radially outer surface 52 of the hub filler 50 is configured to provide a smooth aerodynamic surface 52 of the hub 48 when the hub filler 50 is installed into one of the slots 20 of the hub 48. In an impeller 10 having 33 slots for receipt of 33 blades, for instance, the rate of flow produced by the impeller can be reduced by approximately two-thirds, by replacing every other blade with a hub filler 50 such that the resulting impeller has only eleven blades rather than 33.

From the foregoing description, those skilled in the art will readily recognize that the bladed device 12 and turbomachine 10 of our invention overcome problems encountered in prior bladed devices and turbomachines. Our invention allows bladed devices of complex shape, such as those illustrated in the exemplary embodiments depicted by FIGS. 1 through 7 to be readily and economically manufactured by a variety of processes including injection molding. Our invention also provides a method for conveniently repairing bladed devices of such complex geometries. Specifically, by configuring the blades and hub of our invention to include integral snap action, self-energizing, self-locking features for inserting and retaining the blade in the hub, our invention eliminates the need for any additional retention or installation means, thereby reducing the complexity and cost of the bladed device. Our invention also allows the shape or number of blades attached to a given hub of the bladed device to be conveniently changed for altering the performance of the bladed device for a turbomachine incorporating the bladed device.

Those skilled in the art will further recognize that although we have described our invention herein with respect to certain specific embodiments of a bladed device for a turbomachine, many other embodiments and applications of our invention are possible within the scope of our invention as described in the appended claims. We wish to specifically point out that our invention is by no means limited to bladed devices in turbomachines. Other types of devices such as boring bits or augers for instance, might also benefit by use of the blade insertion and retention means of our invention. It is understood, therefore, that the spirit and scope of the appended claims should not be limited to the specific embodiments described and depicted herein.

We claim:

1. A bladed device comprising:

a hub rotatable about an axis; and a blade attached to said hub by insertion and retention means integrally formed with said hub and said blade and configured for axially directed insertion of said blade into said hub and self-locking retention therein against both axially and radially directed forces acting on said blade.

2. The bladed device of claim 1 wherein said insertion and retention means are configured to resist axially directed forces acting in one direction along said axis.

3. The bladed device of claim 1 wherein said insertion and retention means are configured to resist axially directed forces acting in either direction along said axis.

4. The bladed device of claim 1 wherein said insertion and retention means are configured to be self-energizing such that forces generated in said blade or insertion and retention means by virtue of rotation of said hub about said axis urge said retention means to remain locked into said hub.

5. The bladed device of claim 1 wherein said insertion and retention means are configured such that following engagement of the insertion and retention means said blade may be removed from said hub without permanently deforming either the blade or the hub.

6. The bladed device of claim 1 wherein said bladed device further includes hub filler means attached to said hub by insertion and retention means configured for axially directed insertion of said hub filler means into said hub and self-locking retention therein against both axially and radially directed forces acting on said hub filler means.

7. The bladed device of claim 6 wherein said hub includes a plurality of slot means for receiving said insertion and retention means of a plurality of said blades or said hub filler means with said hub filler means being disposed in said slot means not having said blades disposed therein.

8. The bladed device of claim 1 wherein said insertion and retention means include:

an axially opening and directed blade retention slot in said hub; and a blade root fitting integrally joined to said blade at a radially inner end thereof and configured to enter said blade retaining slot of said hub in an axial direction, with said root fitting and slot being configured in a complimentary manner to provide retention of said blade within said slot against radially directed forces on said blade;

said root fitting including a radially flexible, snap-action, locking tang extending axially therefrom into said hub; and said locking tang and hub including axial positioning and detent means for locking said blade into said hub against the action of axially directed forces operating on said blade with respect to said hub.

9. The bladed device of claim 8 wherein said detent means are configured to deflect said locking tang radially inward during insertion of the blade into said hub at an axial position prior to a predetermined axial engagement location of said blade with respect to said hub and to allow said locking tang to snap radially outward at said engagement location for locking said blade into said hub.

10. The bladed device of claim 9 wherein said detent means are configured to allow removal of said blade without permanent deformation of either said blade or hub after said detent means have locked said blade into said hub at said engagement location by deflecting said locking tang radially inward to disengage said detent means and moving said blade axially while said detent means are thus disengaged.

11. The bladed device of claim 8 wherein said detent means are configured to lock the blade and hub together against axially directed forces acting in one axial direction against said blade with respect to said hub.

12. The bladed device of claim 11 wherein said hub and blade are configured to include shoulder means for locking the blade and hub together against axially directed forces acting in a direction opposite to said one axial direction on said blade with respect to said hub.

13. The bladed device of claim 8 wherein said detent means are configured to lock the blade and hub together against axially directed forces acting in either direction along said axis on said blade with respect to said hub.

14. The bladed device of claim 8 wherein said hub defines a radially inner wall thereof and said detent means include:

a blade retaining ridge extending radially inward from said radially inner wall of said hub to a point of contact with said locking tang; and said tang includes a radially outward extending locking pawl portion thereof configured to: (a) deflect the locking tang radially inward as the locking pawl passes by the blade retaining ridge while the blade is being inserted into the slot of the hub; (b) allow said locking tang to snap radially outward once said locking pawl portion passes said blade retaining ridge; and (c) engage said blade retaining ridge in a manner locking said blade to said hub against axially directed forces acting on said blade with respect to said hub, to thereby retain said blade axially within said hub.

15. A turbomachine including a bladed device comprising: a hub rotatable about an axis; and a blade attached to said hub by insertion and retention means integrally formed with said hub and said blade and configured for axially directed insertion of said blade into said hub and self-locking retention therein against both axially and radially directed forces acting on said blade;

wherein said insertion and retention means include:

an axially opening and directed blade retention slot in said hub; and a blade root fitting integrally joined to said blade at a radially inner end thereof and configured to enter said blade retaining slot of said hub in an axial direction, with said root fitting and slot being configured in a complimentary manner to provide retention of said blade within said slot against radially directed forces on said blade;

said root fitting including a radially flexible, snap-action, locking tang extending axially therefrom into said hub; and said locking tang and hub including axial positioning and detent means for locking said blade into said hub against the action of axially directed forces operating on said blade with respect to said hub.

16. The turbomachine of claim 15 wherein said detent means are configured to deflect said locking tang radially inward during insertion of the blade into said hub at an axial position prior to a predetermined axial engagement location of said blade with respect to said hub and to allow said locking tang to snap radially outward at said engagement location for locking said blade into said hub.

17. The turbomachine of claim 16 wherein said detent means are configured to allow removal of said blade without permanent deformation of either said blade or hub after said detent means have locked said blade into said hub at said engagement location by deflecting said locking tang radially inward to disengage said detent means and moving said blade axially while said detent means are thus disengaged.

18. In a bladed device including:

a hub rotatable about an axis; and a blade attached to said hub by insertion and retention means integrally formed with said hub and said blade and configured for axially directed insertion of said blade into said hub and self-locking retention therein against both axially and radially directed forces acting on said blade;

wherein said insertion and retention means include:

an axially opening and directed blade retention slot in said hub; and a blade root fitting integrally joined to said blade at a radially inner end thereof and configured to enter said blade retaining slot of said hub in an axial direction, with said root fitting and slot being configured in a complimentary manner to provide retention of said blade within said slot against radially directed forces on said blade;

said root fitting including a radially flexible, snap-action, locking tang extending axially therefrom into said hub; and said locking tang and hub including axial positioning and detent means for locking said blade into said hub against the action of axially directed forces operating on said blade with respect to said hub; and wherein said detent means are configured to deflect said locking tang radially inward during insertion of the blade into said hub at an axial position prior to a predetermined axial engagement location of said blade with respect to said hub and to allow said locking tang to snap radially outward at said engagement location for locking said blade into said hub; a method of manufacturing said bladed device including the step of:

(a) inserting said blade into said blade retention slot of said hub in an axial direction to said engagement location.

19. The method of claim 18 including the further step of:

(b) integrally joining said blade to said hub.

20. The method of claim 18 including the further step of:

(b) removing said blade by deflecting said locking tang radially inward to disengage said detent means and moving said blade axially while said detent means are thus disengaged.

21. The method of claim 20 including the further step of:

(c) replacing the blade removed in step (b) with another blade.

22. The method of claim 20 including the further step of:

(c) replacing the blade removed in step (b) with a hub filler.

23. The method of claim 18 including the further steps of:

(b) removing said blade from said hub by deflecting said locking tang radially inward to disengage said detent means and moving said blade axially while said detent means are thus disengaged; and (c) replacing said hub with a different hub rotatable about said axis, said different hub including:

insertion and retention means having an axially opening and directed blade retention slot configured to provide retention of said blade within said slot of said different hub against radially directed forces on said blade; and axial positioning and detent means for locking said blade into said hub against the action of axially directed forces On said blade with respect to said different hub;

wherein said detent means are configured to deflect said locking tang radially inward during insertion of said blade into said different hub at an axial position prior to a predetermined axial engagement location of said blade with respect to said different hub;

(d) inserting said blade removed in step (b) into said slot of said different hub in an axial direction to said predetermined axial engagement location of said blade with respect to said different hub.

24. In a turbomachine including a bladed device having: a hub rotatable about an axis; and a plurality of blades attached to said hub by insertion and retention means integrally formed with said hub and said blades and configured for axially directed insertion of said blades into said hub and self-locking retention therein against both axially and radially directed forces acting on said blades;

wherein said insertion and retention means include:

axially opening and directed blade retention slots in said hub; and each of said blades includes a blade root fitting integrally joined to said blade at a radially inner end thereof and configured to enter said blade retaining slots of said hub in an axial direction, with said root fittings and slots being configured in a complimentary manner to provide retention of one of said blades within each of said slots against radially directed forces on said blade;

said root fitting including a radially flexible, snap-action, locking tang extending axially therefrom into said hub; and said locking tang and hub including axial positioning and detent means for locking said blade into said hub against the action of axially directed forces operating on said blade with respect to said hub; and wherein said detent means are configured to deflect said locking tang radially inward during insertion of the blade into said hub at an axial position prior to a predetermined axial engagement location of said blade with respect to said hub and to allow said locking tang to snap radially outward at said engagement location for locking said blade into said hub; a method of manufacturing said turbomachine including the step of:

(a) inserting said blades into said slots of said hub of said bladed device in an axial direction to said engagement location.

25. The method of claim 24 including the further steps of:

(b) removing at least one of said blades by deflecting said locking tang radially inward to disengage said detent means and moving said blade axially while said detent means are thus disengaged; and (c) replacing the blade removed in step (b) with another blade having a fluid reacting portion configured differently from the blade removed in step (b);

to thereby alter a performance characteristic of the turbomachine.

26. The method of claim 24 including the further steps of:

(b) measuring the imbalance of the bladed device manufactured in step (a);

(c) removing at least one of said blades by deflecting said locking tang radially inward to disengage said detent means and moving said blade axially while said detent means are thus disengaged; and (d) replacing the blade removed in step (c) with another blade having a dynamic moment different from the blade removed in step (b);

to thereby alter the imbalance of the turbomachine.

27. The method of claim 24 including the further steps of:

(b) removing at least one of said blades by deflecting said locking tang radially inward to disengage said detent means and moving said blade axially while said detent means are thus disengaged; and (c) replacing the blade removed in step (b) with a hub filler; to thereby alter a performance characteristic of the turbomachine.

28. In a turbomachine including a bladed device having:

a hub rotatable about an axis; and a plurality of blades attached to said hub by insertion and retention means integrally formed with said hub and said blades and configured for axially directed insertion of said blades into said hub and self-locking retention therein against both axially and radially directed forces acting on said blades;

wherein said insertion and retention means include:

axially opening and directed blade retention slots in said hub; and each of said blades includes a blade root fitting integrally joined to said blade at a radially inner end thereof and configured to enter said blade retaining slots of said hub in an axial direction, with said root fitting and slot being configured in a complimentary manner to provide retention of one of said blade within each of said slots against radially directed forces on said blade;

said root fitting including a radially flexible, snap-action, locking tang extending axially therefrom into said hub; and said locking tang and hub including axial positioning and detent means for locking said blade into said hub against the action of axially directed forces operating on said blade with respect to said hub; and wherein said detent means are configured to deflect said locking tang radially inward during insertion of the blade into said hub at an axial position prior to a predetermined axial engagement location of said blade with respect to said hub and to allow said locking tang to snap radially outward at said engagement location for locking said blade into said hub; a method of manufacturing said turbomachine including the steps of:

(a) measuring the imbalance of said hub;

(b) calculating the dynamic moment required for a blade inserted into each of the blade retaining slots to compensate for said imbalance of the hub; and (c) inserting a blade having the appropriate dynamic moment as calculated in step (b) into each of said slots in said hub of said bladed device in an axial direction to said engagement location;

to thereby provide a balanced bladed device without resorting to removing or adding material to the bladed device solely for purposes of balancing.

29. In a bladed device comprising:

a hub rotatable about an axis;

a plurality of blades attached to said hub; and a plurality of hub fillers attached to said hub;

said blades and hub fillers being attached to said hub by insertion and retention means integrally formed with said hub and said blades and hub fillers;

said insertion and retention means being configured for axially directed insertion of said blades and hub fillers into said hub and self-locking retention therein against both axially and radially directed forces acting on said blades and hub fillers;

wherein said insertion and retention means include:

axially opening and directed blade retention slots in said hub; and each of said blades and hub fillers includes a blade root fitting, integrally joined to said blade and hub filler at a radially inner end thereof, and configured to enter said blade retaining slots of said hub in an axial direction, with said root fittings and slots being configured in a complementary manner to provide retention of one of said blades or one of said hub fillers within each of said slots against radially directed forces on said blade or hub filler;

said root fitting including a radially flexible, snap-action, locking tang extending axially therefrom into said hub; and said locking tang and hub including axial positioning and detent means for locking said blade or said hub filler into said hub against the action of axially directed forces operating on said blade or hub filler with respect to said hub; and wherein said detent means are configured to deflect said locking tang radially inward during insertion of the blade or hub filler into said hub at an axial position prior to a predetermined axial engagement location of said blade or hub filler with respect to said hub and to allow said locking tang to snap radially outward at said engagement location for locking said blade or hub filler into said hub; a method of manufacturing said blade device including the steps of:

(a) inserting said blades and hub fillers into said slots of said hub of said bladed device in an axial direction to said engagement location;

(b) measuring the imbalance of the bladed device manufactured in step (a);

(c) removing at least one of said blades or hub fillers by deflecting said locking tang radially inward to disengage said detent means and moving said blade or hub filler axially while said detent means are thus disengaged; and (d) replacing the blade or hub filler removed in step (c) with another blade or hub filler having a dynamic moment different from the blade or hub filler removed in step (b);

to thereby alter the imbalance of the bladed device.

30. In a bladed device comprising:

a hub rotatable about an axis;

a plurality of blades attached to said hub; and a plurality of hub fillers attached to said hub;

said blades and hub fillers being attached to said hub by insertion and retention means integrally formed with said hub and said blades and hub fillers;

said insertion and retention means being configured for axially directed insertion of said blades and hub fillers into said hub and self-locking retention therein against both axially and radially directed forces acting on said blades and hub fillers;

wherein said insertion and retention means include:

axially opening and directed blade retention slots in said hub; and each of said blades and hub fillers includes a blade root fitting, integrally joined to said blade and hub filler at a radially inner end thereof, and configured to enter said blade retaining slots of said hub in an axial direction, with said root fittings and slots being configured in a complementary manner to provide retention of one of said blades or one of said hub fillers within each of said slots against radially directed forces on said blade or hub filler;

said root fitting including a radially flexible, snap-action, locking tang extending axially therefrom into said hub; and said locking tang and hub including axial positioning and detent means for locking said blade or said hub filler into said hub against the action of axially directed forces operating on said blade or hub filler with respect to said hub; and wherein said detent means are configured to deflect said locking tang radially inward during insertion of the blade or hub filler into said hub at an axial position prior to a predetermined axial engagement location of said blade or hub filler with respect to said hub and to allow said locking tang to snap radially outward at said engagement location for locking said blade or hub filler into said hub; a method of manufacturing said blade device including the steps of:

(a) measuring the imbalance of said hub;

(b) calculating the dynamic moment required for a blade or a hub filler inserted into each of the blade retaining slots to compensate for said imbalance of the hub; and (c) inserting a blade or hub filler having the appropriate dynamic moment as calculated in step (b) into each of said slots in said hub of said bladed device in an axial direction to said engagement location;

to thereby provide a balanced bladed device without resorting to removing or adding material to the bladed device solely for purposes of balancing.

* * * * *